US011421586B2

(12) United States Patent
Liu et al.

(10) Patent No.: US 11,421,586 B2
(45) Date of Patent: Aug. 23, 2022

(54) SIX-CYLINDER OPPOSED FREE PISTON INTERNAL COMBUSTION ENGINE GENERATOR

(71) Applicant: Harbin Engineering University, Harbin (CN)

(72) Inventors: Long Liu, Harbin (CN); Chen An, Harbin (CN); Zhichun Xu, Harbin (CN); Yuanheng Tang, Harbin (CN); Hao Zhao, Harbin (CN); Xiao Han, Harbin (CN); Junjie Liu, Harbin (CN); Qihao Mei, Harbin (CN)

(73) Assignee: Harbin Engineering University, Harbin (CN)

( * ) Notice: Subject to any disclaimer, the term of this patent is extended or adjusted under 35 U.S.C. 154(b) by 0 days.

(21) Appl. No.: 17/565,531

(22) Filed: Dec. 30, 2021

(65) Prior Publication Data

US 2022/0120214 A1 Apr. 21, 2022

(30) Foreign Application Priority Data

Mar. 12, 2021 (CN) ..... 2021102721828.8

(51) Int. Cl.

| | |
|---|---|
| ***F02B 71/04*** | (2006.01) |
| ***F02B 33/20*** | (2006.01) |
| ***F02B 41/06*** | (2006.01) |
| ***F02B 75/00*** | (2006.01) |
| ***F02B 75/18*** | (2006.01) |

(52) U.S. Cl.

CPC ..... *F02B 71/04* (2013.01); *F02B 33/20* (2013.01); *F02B 41/06* (2013.01); *F02B 75/002* (2013.01); *F02B 75/18* (2013.01); *F02B 2075/1812* (2013.01)

(58) Field of Classification Search

CPC ..... F02B 2075/1812; F02B 75/18; F02B 75/002; F02B 41/06; F02B 33/20; F02B 71/04

See application file for complete search history.

(56) References Cited

U.S. PATENT DOCUMENTS 1,785,643 A * 12/1930 Noack ..... H02P 9/00 310/15

FOREIGN PATENT DOCUMENTS

CN 102418600 B * 7/2013
WO WO-2011006797 A1 * 1/2011 ..... F01B 11/02

* cited by examiner

*Primary Examiner* — Kevin A Lathers
(74) *Attorney, Agent, or Firm* — IPro, PLLC

(57) ABSTRACT

The present disclosure provides a six-cylinder opposed free piston internal combustion engine generator. The generator comprises two free piston internal combustion engine sets, one opposed piston internal combustion engine set and two linear generator sets. Air entering cylinders is subjected to first-stage compression in low-pressure cylinder sets in the free piston internal combustion engine sets and the opposed piston internal combustion engine set and then subjected to second-stage compression in high-pressure cylinder sets, and a high pressure gas produced after the combustion is subjected to first-stage expansion in the high-pressure cylinder sets and then subjected to second-stage expansion in the low-pressure cylinder sets.

10 Claims, 1 Drawing Sheet

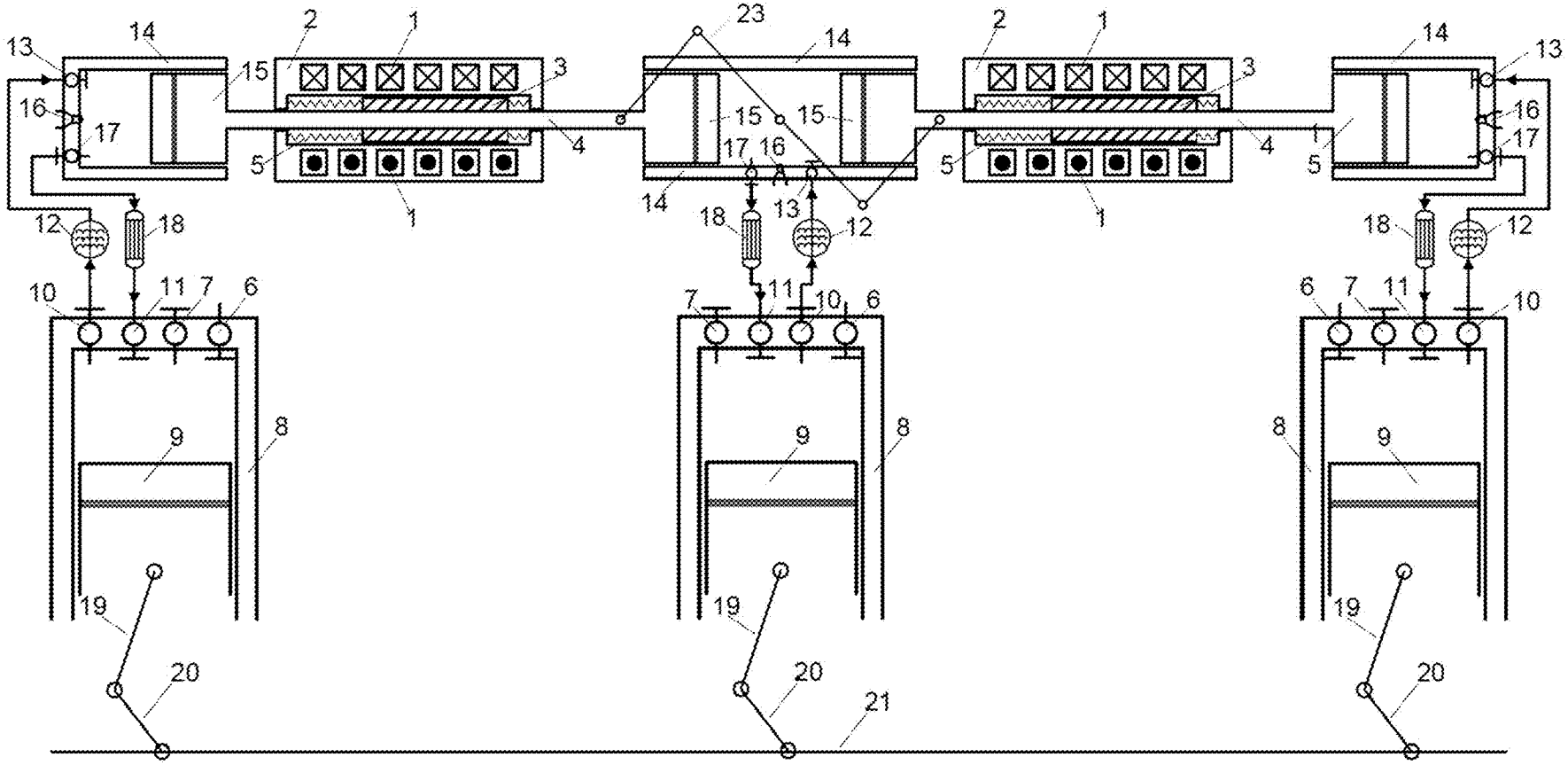
1
2
3
4
5
6
7
8
9
10
11
12
13
14
15
16
17
18
19
20
21
23

SIX-CYLINDER OPPOSED FREE PISTON INTERNAL COMBUSTION ENGINE GENERATOR

TECHNICAL FIELD

The present disclosure relates to a six-cylinder opposed free piston internal combustion engine generator, and belongs to the technical field of energy conversion devices.

BACKGROUND

With the continuous development of society, the demand of people on energy is increasing, and the energy has become the main problem that restricts the further development of all trades. Among various forms of energy, electric energy is one of the most widely used energy, and electric energy is mainly provided by traditional diesel engines in the industries of vehicles, ships and the like.

In the traditional diesel engine power generation process, the energy transmission mode includes that chemical energy of fuel is first converted into mechanical energy output by a crankshaft through combustion in-cylinder, and then this part of mechanical energy drives a motor to generate power and convert into electric energy. The whole energy conversion process is carried out through a lot of steps, and meanwhile, a lot of energy is lost due to complex mechanical structures of the diesel engine, so that the whole power generation efficiency is low.

A free piston generator couples the working characteristics of a free piston internal combustion engine and a linear generator can directly convert chemical energy of fuel into electric energy, and has higher power generation efficiency and economic performance compared with a commercial internal combustion engine power generation, but an existing dual piston dual cylinder type free-piston internal combustion engine linear generator needs two pairs of cylinders to drive excitation coils of one generator, and has lower power density. Although the power density of an opposed free piston generator is high, the reliability of the device is reduced due to a return device, the failure rate of the internal combustion engine generator is increased, and the opposed free piston generator is difficult to popularize.

SUMMARY

The present disclosure provides a six-cylinder opposed free piston internal combustion engine generator, which aims to solve technical problems about how to improve the power generation efficiency of an opposed free piston generator and improve the reliability of the device, a dual piston dual cylinder type free-piston internal combustion engine linear generator is used for replacing a return device in the opposed free piston generator, and the reliability and the power generation efficiency of the device are improved.

The present disclosure provides a six-cylinder opposed free piston internal combustion engine generator, including: two free piston internal combustion engine sets, one opposed piston internal combustion engine set and two linear generator sets, where two sides of the opposed piston internal combustion engine set are respectively connected to the two linear generator sets, each opposed piston internal combustion engine set is connected to one free piston internal combustion engine set, the linear generator set includes a stator coil, a motor shell, a generator rotor, a rotor mandrel and a spring, the stator coil is fixed inside the motor shell, the generator rotor is fixed on the rotor mandrel, along with movement of the rotor mandrel driven by the free piston internal combustion engine set and the opposed piston internal combustion engine set on the two sides, the generator rotor cuts a magnetic induction line generated by the stator coil for power generation; the spring is arranged between the generator rotor and the motor shell to limit movement of the rotor mandrel;

the two free piston internal combustion engine sets and one opposed piston internal combustion engine set each include a low-pressure cylinder set, a high-pressure cylinder set, an intercooler and an exhaust gas communicating pipe; and the intercooler and the exhaust gas communicating pipe are connected between the low-pressure cylinder set and the high-pressure cylinder set, air is subjected to first-stage compression in the low-pressure cylinder set in the free piston internal combustion engine set and the opposed piston internal combustion engine set and then subjected to second-stage compression in the high-pressure cylinder set, and a high pressure gas produced after the combustion is subjected to first-stage expansion in the high-pressure cylinder set and then subjected to second-stage expansion in the low-pressure cylinder set.

Preferably, two opposed pistons are arranged in the opposed piston internal combustion engine set, a piston is arranged in the free piston internal combustion engine set, the two opposed pistons in the opposed piston internal combustion engine sets are respectively connected to pistons of two free piston internal combustion engine sets, and share one rigid connecting rod, and the generator rotor of the linear generator set is fixed on the rigid connecting rod, and moves in a reciprocating manner along with the connecting rod.

Preferably, phases of the two opposed pistons of the two opposed piston internal combustion engine sets are implemented by a synchronizing mechanism.

Preferably, the low-pressure cylinder set includes a low-pressure inlet valve, a low-pressure exhaust valve, a low-pressure cylinder, a low-pressure piston, an air outlet valve and an exhaust gas inlet; and the low-pressure inlet valve, the low-pressure exhaust valve, the air outlet valve and the exhaust gas inlet are arranged at the head of the low-pressure cylinder, air enters the low-pressure cylinder from the low-pressure inlet valve, and is subjected to first-stage compression under the action of the low-pressure piston, and compressed air enters the intercooler for cooling from the air outlet valve.

Preferably, air enters the low-pressure cylinder from the low-pressure inlet valve, and is subjected to first-stage compression under the action of the low-pressure piston, the compressed air enters the intercooler for cooling from the air outlet valve, the compressed air in the intercooler enters the high-pressure cylinder through the high-pressure inlet valve, and is subjected to second-stage compression under the action of the high-pressure piston, after a compression process is completed, the fuel injector is triggered near the TDC (Top dead center) of compression process, a combustion process occurs in the high-pressure cylinder, high pressure gas produced after the combustion after the combustion process in the cylinder pushes the high-pressure piston to be subjected to first-stage expansion, the expanded high pressure gas flows out through the high-pressure exhaust valve to the exhaust gas communicating pipe, and flows through the exhaust gas inlet into the low-pressure cylinder to push the low-pressure piston to be subjected to second-stage expansion, and finally, the completely expanded high pressure gas is discharged to an external environment through the low-pressure exhaust valve.

Preferably, the low-pressure piston is connected to a crank connecting rod mechanism, the crank connecting rod mechanisms of three low-pressure cylinders are connected to the same crankshaft, and alternately drive the crankshaft to rotate.

Preferably, the high-pressure cylinder set includes a high-pressure inlet valve, a high-pressure exhaust valve, a high-pressure cylinder, a high-pressure piston and a injector; and the high-pressure inlet valve, the injector and the high-pressure exhaust valve are arranged on the high-pressure cylinder, and the high-pressure piston is connected to the rotor mandrel in the linear generator set.

Preferably, compressed air in the intercooler enters the high-pressure cylinder through the high-pressure inlet valve, and is subjected to second-stage compression under the action of the high-pressure piston, after a compression process is completed, the fuel injector is triggered near the TDC, a combustion process occurs in the high-pressure cylinder, high pressure gas pushes the high-pressure piston to be subjected to first-stage expansion, the expanded high pressure gas flows out through the high-pressure exhaust valve to the exhaust gas communicating pipe, and then flows through the exhaust gas inlet into the low-pressure cylinder to push the low-pressure piston to be subjected to second-stage expansion, and finally, the completely expanded high pressure gas is discharged to the external environment through the low-pressure exhaust valve.

Preferably, the low-pressure piston and the high-pressure piston each are provided with a piston ring, a lubricating effect in the cylinders is improved, and leakage of air and high pressure gas is prevented.

Preferably, the stroke of the low-pressure cylinder is the same as that of the high-pressure cylinder, the diameter and volume of the low-pressure cylinder are greater than those of the high-pressure cylinder, a temperature sensor and a pressure sensor which are used for monitoring working states in the cylinders are mounted on each of cylinder heads of the low-pressure cylinder and the high-pressure cylinder, the compression ignition is adopted in the high-pressure cylinder which enables self-ignition of diesel sprays after fuel injection.

The six-cylinder opposed free piston internal combustion engine generator provided by the present disclosure has the beneficial effects:

1. According to the free piston engine set and the opposed piston engine set in the present disclosure, air entering cylinders is subjected to first-stage compression in the low-pressure cylinder set in the internal combustion engine set, and then subjected to second-stage compression in the high-pressure cylinder, the inlet pressure of internal combustion engines is effectively increased, average effective pressure in a working process is increased, and thus, the thermal efficiency and power generation efficiency of the free piston generator are improved.

2. A high pressure gas produced after the combustion is subjected to first-stage expansion in the high-pressure cylinder, and then subjected to second-stage expansion in the low-pressure cylinder, such that energy utilization rate of exhaust gas is effectively increased, expansion work is improved, and the thermal efficiency and power generation efficiency of the free piston generator are further improved.

3. The free piston generator in the present disclosure is located in a high-temperature environment, the volume and surface area of the high-pressure cylinders responsible for combustion are small, heat transfer loss of a working process can be reduced, and the energy utilization rate is increased.

4. According to the six-cylinder opposed free piston internal combustion engine generator provided by the present disclosure, the power generation efficiency of the opposed free piston generator is improved, and a dual piston dual cylinder type free-piston internal combustion engine linear generator is used for replacing a return device in the opposed free piston generator, and the reliability of the device is improved.

BRIEF DESCRIPTION OF FIGURES

The accompanying drawings constituting a part of the present application serve to provide a further understanding of the present disclosure, and illustrative examples of the present disclosure and descriptions thereof serve to explain the present disclosure and do not constitute an undue limitation of the present disclosure.

In drawings:

FIG. 1 is a structure diagram of a six-cylinder opposed free piston internal combustion engine generator according to the present disclosure;

reference numerals: 1—stator coil; 2—motor shell; 3—generator rotor; 4—rotor mandrel; 5—spring; 6—low-pressure inlet valve; 7—low-pressure exhaust valve; 8—low-pressure cylinder; 9—low-pressure piston; 10—air outlet valve; 11—exhaust gas inlet; 12—intercooler; 13—high-pressure inlet valve; 14—high-pressure cylinder; 15—high-pressure piston; 16—fuel injector; 17—high-pressure exhaust valve; 18—exhaust gas communicating pipe; 19—low-pressure cylinder connecting rod; 20—low-pressure cylinder crank; 21—low-pressure cylinder set crankshaft; and 23—synchronizing mechanism.

DETAILED DESCRIPTION

It may be understood that the specific implementations described herein are only used for explaining present disclosure rather than limiting the present disclosure. Unless otherwise defined, all technical and scientific terms used herein are the same as meanings of general understandings of those skilled in the art of the disclosure. The terms used in the specification of the present disclosure herein are only for the purpose of describing specific embodiments, but are not intended on the limit the present disclosure.

A first specific implementation is as follows: the present implementation is explained with reference to FIG. 1. The six-cylinder opposed free piston internal combustion engine generator in the present implementation includes two free piston internal combustion engine sets, one opposed piston internal combustion engine set and two linear generator sets, two sides of the opposed piston internal combustion engine set are respectively connected to the two linear generator sets, and each opposed piston internal combustion engine set is connected to one free piston internal combustion engine set.

The linear generator set includes a stator coil 1, a motor shell 2, a generator rotor 3, a rotor mandrel 4 and a spring 5, the stator coil 1 is fixed inside the motor shell 2, the generator rotor 3 is fixed on the rotor mandrel 4, along with movement of the rotor mandrel 4 driven by the free piston internal combustion engine set and the opposed piston internal combustion engine set on the two sides, the generator rotor 3 cuts a magnetic induction line generated by the stator coil 1 for power generation; the spring 5 is arranged between the generator rotor 3 and the motor shell 2 to limit movement of the rotor mandrel 4.

The two free piston internal combustion engine sets and one opposed piston internal combustion engine set each include a low-pressure cylinder set, a high-pressure cylinder set, an intercooler 12 and an exhaust gas communicating pipe 18; and the intercooler 12 and the exhaust gas communicating pipe 18 are connected between the low-pressure cylinder set and the high-pressure cylinder set, air entering cylinders is subjected to first-stage compression in low-pressure cylinder set in the free piston internal combustion engine set and the opposed piston internal combustion engine set and then subjected to second-stage compression in the high-pressure cylinder set, and a high pressure gas produced after the combustion is subjected to first-stage expansion in the high-pressure cylinder set and then subjected to second-stage expansion in the low-pressure cylinder set.

Two high-pressure pistons 15 are arranged in the high-pressure cylinder set in the opposed piston internal combustion engine set, so that the volume efficiency of the high-pressure cylinder 14 is improved.

Air entering the cylinders is subjected to first-stage compression in the low-pressure cylinder set in the internal combustion engine set, and subjected to second-stage compression in the high-pressure cylinder, the inlet pressure of internal combustion engines is effectively increased, average effective pressure in a working process is increased, and thus, the thermal efficiency and power generation efficiency of the free piston generator are improved. A high pressure gas produced after the combustion is subjected to first-stage expansion in the high-pressure cylinder, and then subjected to second-stage expansion in the low-pressure cylinder, such that energy utilization rate in exhaust gas is increased effectively, expansion work is increased, and the thermal efficiency and power generation efficiency of the free piston generator are further improved.

Two opposed pistons are arranged in the opposed piston internal combustion engine set, one piston is arranged in the free piston internal combustion engine set, the two opposed pistons in the opposed piston internal combustion engine set are respectively connected to the pistons of two free piston internal combustion engine sets, and share a rigid connecting rod, and the generator rotor 3 of the linear generator set is fixed on the rigid connecting rod, and moves in a reciprocating manner along with the connecting rod. A power generation portion of the linear generator set mainly includes a permanent magnet and a magnet exciting coil, the permanent magnet serves as the generator rotor 3, is fixed on the rigid connecting rod, and moves in a reciprocating manner along with the connecting rod, and the magnet exciting coil serves as a stator, sleeves the periphery the permanent magnet and is kept fixed.

Phases of the two opposed pistons of the two opposed piston internal combustion engine sets are implemented by a synchronizing mechanism 23.

The low-pressure cylinder set includes a low-pressure inlet valve 6, a low-pressure exhaust valve 7, a low-pressure cylinder 8, a low-pressure piston 9, an air outlet valve 10 and an exhaust gas inlet 11; and the low-pressure inlet valve 6, the low-pressure exhaust valve 7, the air outlet valve 10 and the exhaust gas inlet 11 are arranged on the top of the low-pressure cylinder 8, air enters the low-pressure cylinder from the low-pressure exhaust valve 7, and is subjected to first-stage compression under the action of the low-pressure piston 9, and the compressed air enters an intercooler 12 for cooling from the air outlet valve 10.

Air enters the low-pressure cylinder 8 from the low-pressure inlet valve 6, and is subjected to first-stage compression under the action of the low-pressure piston 9, the compressed air enters the intercooler 12 for cooling from the air outlet valve 10, the compressed air in the intercooler 12 enters the high-pressure cylinder 14 through the high-pressure inlet valve 13, and is subjected to second-stage compression under the action of the high-pressure piston 15, after the compression process is completed, a fuel injector 16 is triggered near the TDC, a combustion process occurs in the high-pressure cylinder 14, high pressure gas pushes the high-pressure piston 15 to be subjected to first-stage expansion, the expanded high pressure gas flows out through the high-pressure exhaust valve 17 to the exhaust gas communicating pipe 18, and flows into the low-pressure cylinder 8 through the exhaust gas inlet 11 to push the low-pressure piston 9 to be subjected to second-stage expansion, and finally, the completely expanded high pressure gas is discharged into an external environment through the low-pressure exhaust valve 7.

The low-pressure piston 9 is connected to a crank connecting rod mechanism, and the crank connecting rod mechanisms of three low-pressure cylinders 8 are connected to the same low-pressure cylinder set crankshaft 21, and alternately drive the crankshaft to rotate. The crank connecting rod mechanism includes a low-pressure cylinder connecting rod 19 and a low-pressure cylinder crank 20, and the low-pressure cylinder connecting rod 19 is connected to the low-pressure cylinder crank 20.

The high-pressure cylinder set includes a high-pressure inlet valve 13, a high-pressure exhaust valve 17, a high-pressure cylinder 14, a high-pressure piston 15 and a fuel injector 16; and the high-pressure inlet valve 13, the fuel injector 16 and the high-pressure exhaust valve 17 are arranged on the high-pressure cylinder 14, and the high-pressure piston 15 is connected to the rotor mandrel 4 in the linear generator set.

The compressed air in the intercooler 12 enters the high-pressure cylinder 14 through the high-pressure inlet valve 13, and is subjected to second-stage compression under the action of the high-pressure piston 15, after the compression process is completed, the fuel injector 16 sprays fuel oil, a combustion process occurs in the high-pressure cylinder 14, high pressure gas pushes the high-pressure piston 15 to be subjected to first-stage expansion, the expanded high pressure gas flows out through the high-pressure exhaust valve 13 to the exhaust gas communicating pipe 18, flows through the exhaust gas inlet 11 into the low-pressure cylinder 8, and pushes the low-pressure piston 9 to be subjected to second-stage expansion, and finally, the completely expanded high pressure gas is discharged into the external environment through the low-pressure exhaust valve 7.

The low-pressure piston 9 and the high-pressure piston 15 each are provided with a piston ring, a lubricating effect in the cylinders is improved, and leakage of air and high pressure gas is prevented. The piston ring is similar to an annular metal sheet, and is a common technique.

The stroke of the low-pressure cylinder 8 is the same as that of the high-pressure cylinder 14, the diameter and volume of the low-pressure cylinder 8 are greater than those of the high-pressure cylinder 14, the free piston generator is located in a high-pressure environment, and the volume and surface area of the high-pressure cylinder responsible for combustion are small, such that heat transfer loss of a working process can be reduced, and energy utilization rate is increased.

A temperature sensor and a pressure sensor which monitors working states in cylinders are mounted on a cylinder head of each of the low-pressure cylinder 8 and the high-pressure cylinder 14, and a compression ignition type method is adopted in the high-pressure cylinder 14 which enables mixed gas to be self-ignited after fuel injection.

The power generation efficiency of the opposed free piston generator is improved, and a dual piston dual cylinder type free-piston internal combustion engine linear generator is used for replacing a return device in the opposed free piston generator, such that the reliability of the device is improved. It should be noted that a return device in a conventional free piston generator is used for limiting and rebounding a piston. In order to guarantee that the return device adapts to strong impact force generated during running of the piston, the return device needs to have high reliability, and in order to ensure the running speed and phase stability in a rebounding process, the return device needs to be designed complexly. However, loss such as friction is increased due to the complex device, and the power generation efficiency is reduced. The more complex the device, the greater the probability of damage and the more inconvenient of maintenance. Thus, the reliability of the device is reduced due to the complexity of the device.

In the present disclosure, the return device is changed into a free piston engine, power output is increased, unstable running which is possibly caused by the return device is avoided, and the reliability of the device is improved.

The objective, technical solutions and beneficial effects of the present disclosure are further described in detail with reference to the above specific examples. It should be understood that the foregoing descriptions are only specific examples of the present disclosure, are not intended to limit the present disclosure, and may also be a reasonable combination of the characteristics recorded in each of the above embodiments. Any modification, equivalent replacement, improvement and the like made within the spirit and principle of the present disclosure shall be included in the protection scope of the present disclosure.

What is claimed is:

1. A six-cylinder opposed free piston internal combustion engine generator, comprising:

two free piston internal combustion engine sets, one opposed piston internal combustion engine set and two linear generator sets, wherein two sides of the opposed piston internal combustion engine set are respectively connected to the two linear generator sets, each opposed piston internal combustion engine set is connected to one free piston internal combustion engine set, each linear generator set comprises a stator coil (1), a motor shell (2), a generator rotor (3), a rotor mandrel (4) and a spring (5), the stator coil (1) is fixed inside the motor shell (2), the generator rotor (3) is fixed on the rotor mandrel (4), along with movement of the rotor mandrel (4) driven by the free piston internal combustion engine sets and the opposed piston internal combustion engine set on the two sides, the generator rotor (3) passes through a magnetic induction line generated by the stator coil (1) for power generation; the spring (5) is arranged between the generator rotor (3) and the motor shell (2) to limit the movement of the rotor mandrel (4);

two free piston internal combustion engine set and one opposed piston internal combustion engine set each comprise a low-pressure cylinder set, a high-pressure cylinder set, an intercooler (12) and an exhaust gas communicating pipe (18); and the intercooler (12) and the exhaust gas communicating pipe (18) are connected between the low-pressure cylinder set and the high-pressure cylinder set, air entering cylinders is first subjected to first-stage compression in the low-pressure cylinder set in the free piston internal combustion engine set and the opposed piston internal combustion engine set and then subjected to second-stage compression in the high-pressure cylinder set, and a high pressure gas produced after the combustion is subjected to first-stage expansion in the high-pressure cylinder set and then subjected to second-stage expansion in the low-pressure cylinder set.

2. The six-cylinder opposed free piston internal combustion engine generator according to claim 1, wherein two opposed pistons are arranged in the opposed piston internal combustion engine set, one piston is arranged in the free piston internal combustion engine set, the two opposed pistons in the opposed piston internal combustion engine set are respectively connected to pistons of two free piston internal combustion engine sets, and share one rigid connecting rod, and the generator rotor (3) of the linear generator set is fixed on the rigid connecting rod, and moves in a reciprocating manner along with the connecting rod.

3. The six-cylinder opposed free piston internal combustion engine generator according to claim 2, wherein phases of the two opposed pistons of two opposed piston internal combustion engine sets are synchronized.

4. The six-cylinder opposed free piston internal combustion engine generator according to claim 1, wherein the low-pressure cylinder set comprises a low-pressure inlet valve (6), a low-pressure exhaust valve (7), a low-pressure cylinder (8), a low-pressure piston (9), an air outlet valve (10) and an exhaust gas inlet (11); and the low-pressure inlet valve (6), the low-pressure exhaust valve (7), the air outlet valve (10) and the exhaust gas inlet (11) are arranged at a top of the low-pressure cylinder (8), air enters the low-pressure cylinder from the low-pressure exhaust valve (7), and is subjected to first-stage compression under action of the low-pressure piston (9), and compressed air enters the intercooler (12) for cooling from the air outlet valve (10).

5. The six-cylinder opposed free piston internal combustion engine generator according to claim 4, wherein air enters the low-pressure cylinder (8) from the low-pressure inlet valve (6), and is subjected to first-stage compression under action of the low-pressure piston (9), compressed air enters the intercooler (12) for cooling from the air outlet valve (10), compressed air in the intercooler (12) enters the high-pressure cylinder (14) through a high-pressure inlet valve (13), and is subjected to second-stage compression under action of a high-pressure piston (15), after a compression process is completed, a fuel injector (16) sprays fuel oil, a combustion process occurs in the high-pressure cylinder (14), high pressure gas pushes the high-pressure piston (15) to be subjected to first-stage expansion, expanded high pressure gas flows out through a high-pressure exhaust valve (17) to the exhaust gas communicating pipe (18), and flows through the exhaust gas inlet (11) into the low-pressure cylinder (8) to push the low-pressure piston (9) to be subjected to second-stage expansion, and finally, completely expanded high pressure gas is discharged to an external environment through the low-pressure exhaust valve (7).

6. The six-cylinder opposed free piston internal combustion engine generator according to claim 4, wherein the low-pressure piston (9) is connected to a crank connecting rod mechanism, the crank connecting rod mechanisms of three low-pressure cylinders (8) are connected to the same low-pressure cylinder set crankshaft (21), and alternately drive the crankshaft to rotate.

7. The six-cylinder opposed free piston internal combustion engine generator according to claim 4, wherein the high-pressure cylinder set comprises a high-pressure inlet valve (13), a high-pressure exhaust valve (17), a high-pressure cylinder (14), a high-pressure piston (15) and a fuel injector (16); and the high-pressure inlet valve (13), the fuel injector (16) and the high-pressure exhaust valve (17) are arranged on the high-pressure cylinder (14), and the high-pressure piston (15) is connected to the rotor mandrel (4) in the linear generator set.

8. The six-cylinder opposed free piston internal combustion engine generator according to claim 7, wherein compressed air in the intercooler (12) enters the high-pressure cylinder (14) through the high-pressure inlet valve (13), is subjected to second-stage compression under the action of the high-pressure piston (15), after a compression process is completed, the fuel injector (16) sprays fuel oil, a combustion process occurs in the high-pressure cylinder (14), high pressure gas pushes the high-pressure piston (15) to be subjected to first-stage expansion, the expanded high pressure gas flows out through the high-pressure exhaust valve (13) to the exhaust gas communicating pipe (18), and then flows through the exhaust gas inlet (11) into the low-pressure cylinder (8) to push the low-pressure piston (9) to be subjected to second-stage expansion, and finally, the completely expanded high pressure gas is discharged to external environment through the low-pressure exhaust valve (7).

9. The six-cylinder opposed free piston internal combustion engine generator according to claim 8, wherein the low-pressure piston (9) and the high-pressure piston (15) each are provided with a piston ring, a lubricating effect in the cylinders is improved, and leakage of air and high pressure gas is prevented.

10. The six-cylinder opposed free piston internal combustion engine generator according to claim 8, wherein stroke of the low-pressure cylinder (8) is the same as that of the high-pressure cylinder (14), the diameter and volume of the low-pressure cylinder (8) are greater than those of the high-pressure cylinder (14), a temperature sensor and a pressure sensor which are used for monitoring working states in the cylinders are mounted on a cylinder head of each of the low-pressure cylinder (8) and the high-pressure cylinder (14), a compression ignition type method is adopted in the high-pressure cylinder (14) which enables mixed gas to be self-ignited after fuel injection.

* * * * *